United States Patent [19]

Mega

[11] 4,006,442

[45] Feb. 1, 1977

[54] ELECTRONIC TUNING ELEMENT ASSEMBLY

[75] Inventor: Yasunori Mega, Wakuya, Japan

[73] Assignee: Alps Electric Co., Ltd., Tokyo, Japan

[22] Filed: Sept. 11, 1975

[21] Appl. No.: 612,496

[30] Foreign Application Priority Data

Sept. 17, 1974 Japan ..... 49-111887

[52] U.S. Cl. ..... 338/180; 338/196; 338/200

[51] Int. Cl.[2] ..... H01C 10/50

[58] Field of Search ..... 338/134, 179, 180, 196, 338/198, 200; 334/7, 47, 86; 74/10.85

[56] References Cited

UNITED STATES PATENTS

| | | | |
|---|---|---|---|
| 2,942,221 | 6/1960 | DiGirolamo | 338/200 |
| 3,593,152 | 7/1971 | Aoki | 334/7 |
| 3,624,582 | 11/1971 | Iwasaki | 338/129 |
| 3,673,540 | 6/1972 | McDonough | 338/196 |
| 3,792,387 | 2/1974 | Arrington et al. | 338/179 X |

*Primary Examiner*—J. V. Truhe
*Assistant Examiner*—David A. Tone
*Attorney, Agent, or Firm*—Guy W. Shoup

[57] ABSTRACT

A variable tuning resistor has a threaded shaft which moves a slider along a linear resistance element. A flexible ribbon is connected at one end to the slider to be moved thereby. A guide member through which the ribbon is guidingly slidable is oriented perpendicular to the shaft extending upwards. The guide member is formed with a window through which the ribbon is visible. The ribbon is formed with a marking such as a slot obliquely along the length thereof in such a manner that as the ribbon is moved the part of the marking visible through the window appears to move from one side of the window toward the other thus serving as a tuning indication. A rotary band switch is connected to the tuning resistor with the shaft coaxially extending therethrough.

10 Claims, 16 Drawing Figures

ELECTRONIC TUNING ELEMENT ASSEMBLY

The present invention relates to a variable resistor and switch assembly constituting in combination an electronic tuning element assembly.

It is popular in the present art to employ in television receivers a system known as electronic or voltage responsive tuning, in which a variable capacitance diode or varactor is utilized for varying the resonant frequency of a tuning circuit. Tuning is accomplished by varying a tuning voltage applied to the varactor, generally by means of a potentiometer or variable resistor. A varactor resonant circuit is generally provided for each channel which is to be received by the television receiver, and channel selection is accomplished by push buttons or the like without the need for tuning once the varactor resonant circuits are preset.

Commercial broadcast television is generally divided into three bands, a low VHF band, a high VHF band and a UHF band. Each varactor resonant circuit must therefore comprise in addition to the variable tuning resistor a band selector switch to select the required one of the three bands. It is also desirable to provide the variable tuning resistor with an indicator to indicate the tuning frequency.

The present invention is an improvement to this type of tuning assembly as disclosed in U.S. Pat. Nos. 3,624,582 and 3,694,602 to Sadayoshi Iwasaki, Specifically the present invention provides, in addition to a variable tuning resistor assembly disclosed in the above patents, the combination therewith of a band switch and an improved indicator assembly. The above patents further teach the construction of an enabling switch for the variable tuning resistor and an AFC switch which are not the subject matter of the present invention.

It is therefore an important object of the present invention to provide an electronic tuning element assembly comprising, in combination, a variable tuning resistor, a band switch and an improved tuning indicator.

The above and other objects, features and advantages of the present invention will become clear from the following detailed description taken with the accompanying drawings, in which.

Figure 3A:
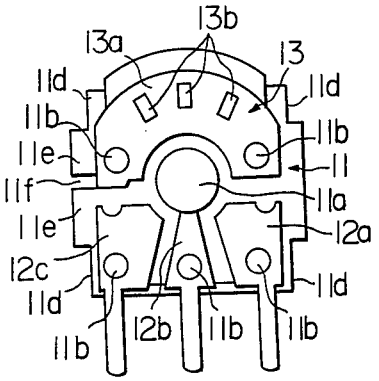
Figure 3B:
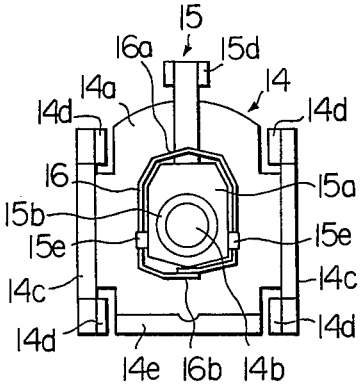
Figure 3C:
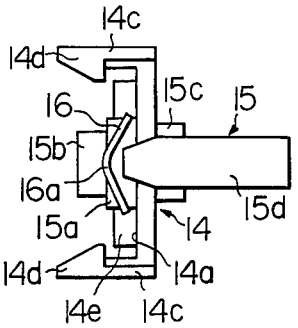
Figure 5:
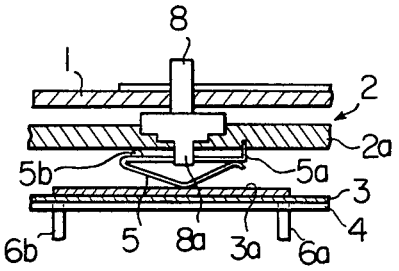
Figure 6:
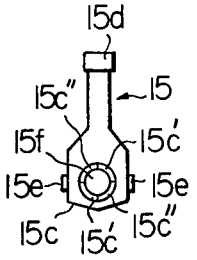
Figure 7:
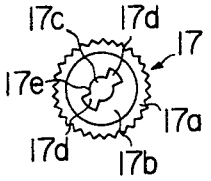
Figure 8:
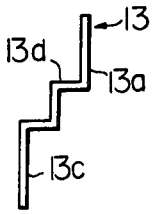
Figure 9:
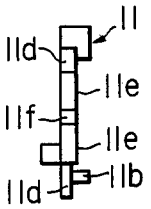
Figure 10:
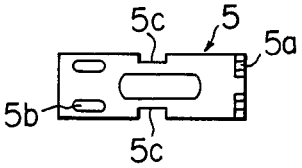
Figure 11:
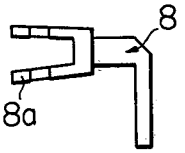

FIGS. 3*a*, 3*b* and 3*c* are schematic views of a rotary band switch constituting an integral part of the tuning element assembly;

FIGS. 4*a*, 4*b*, 4*c* and 4*d* show a tuning indicator constituting an integral part of the tuning element assembly;

FIG. 5 is a fragmentary longitudinal sectional view of a variable tuning resistor constituting an integral part of the tuning element assembly;

FIG. 6 is a sectional elevation of part of the switch shown in FIG. 3;

FIG. 7 is a schematic view of a knob of the switch shown in FIG. 3;

FIG. 8 is a side view of a fixed contact of the switch shown in FIG. 3;

FIG. 9 is a side view of a member of the body of the switch shown in FIG. 3;

FIG. 10 is a top view of part of a slider of the variable tuning resistor shown in FIG. 5; and FIG. 11 is a view of another part of the slider shown in FIG. 5.

Figure 1:
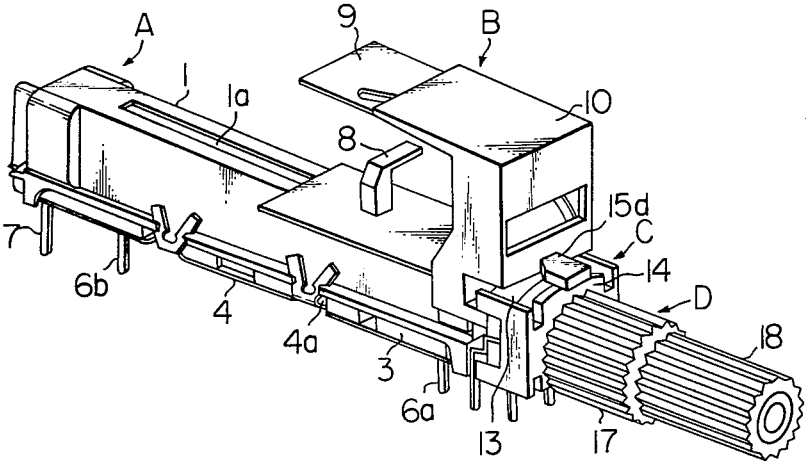
FIG. 1 is a perspective view of an electronic tuning element assembly embodying the present invention.
Figure 2:
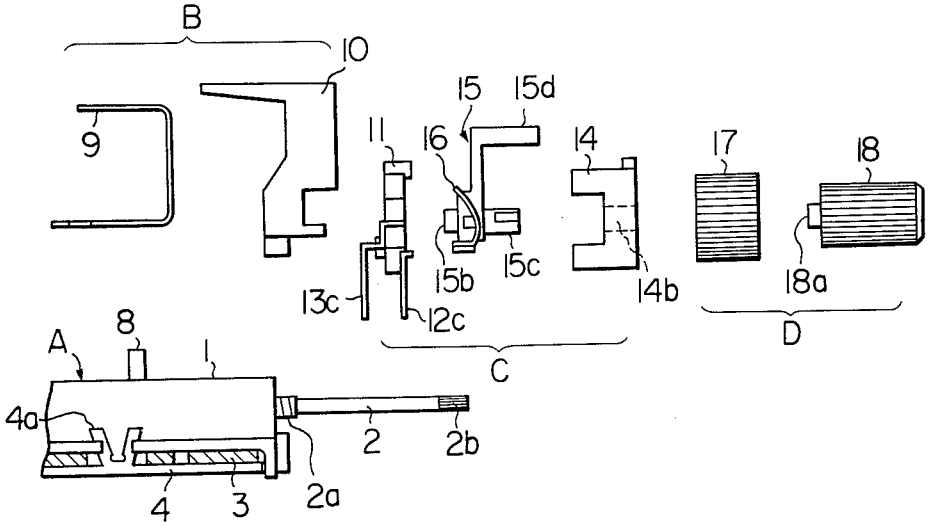
FIG. 2 is an exploded view of the tuning element assembly.

Referring to FIGS. 1 and 2, the tuning element assembly comprises a variable resistor section A, a tuning indicator section B, a rotary band switch section C and a control member section D. The variable resistor section A comprises a casing 1 which rotatably supports a shaft 2. The shaft 2 is threaded at 2*a*. The variable resistor section A has an insulating plate 3 which is fixed to the casing 1 by a base plate 4 which is provided with ears 4*a*. The casing 1 is formed at its top with a longitudinal slot 1*a*.

Referring also to FIG. 5, the variable resistor section A further comprises a contact member or slider 5 which is in ohmic engagement with a linear resistance element 3*a* formed on the insulating plate 3 and a connecting member 8 which is connected to the slider 5 and extends external of the casing 1 through the slot 1*a*. The slider 5 screwably engages with the threaded portion 2*a* of the shaft 2 so that rotation of the shaft 2 causes linear movement of the slider 5 left and right as viewed in FIG. 5. The ends of the resistance element 3*a* are connected to contacts 6*a* and 6*b* respectively. The slider 5 is in ohmic connection with a contact 7 through the shaft 2 which is in rotating sliding ohmic engagement with the contact 7. The contacts 6*a* and 6*b* are connected to a voltage source (not shown) and the contact 7 is the tuning voltage output for the varactor resonant circuit (not shown).

As shown in FIG. 10, the slider 5 is formed with ears 5*a* which ohmically mesh with the threaded portion 2*a* of the shaft 2 for driving the slider 5. Projections 5*b* are formed on the slider 5 which also engage with the shaft 2 to provide a guiding function. Notches 5*c* are cut in the sides of the slider 5 in which fit legs 8*a* of the connecting member 8 (see FIG. 11). In this manner, the connecting member 8 is connected to the slider 5 for integral linear movement therewith.

The indicator section B comprises, as shown in FIG. 4, a guide member 10 which has legs 10*d* and a step 10*e* for detachable connection to the casing 1 and the switch section C, a perpendicular portion 10*f* which is oriented perpendicular to the shaft 2 and a parallel portion 10*g* extending parallel to the shaft 2 from the perpendicular portion 10*f*. A flexible polyester ribbon 9 is connected at one end to the connecting member 8 by means of a hole 9*b* through which the connecting member 8 extends. Linear movement of the slider 5 causes the end of the ribbon 9 to move therewith parallel to the shaft 2.

Figure 4A:
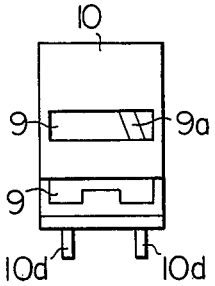
Figure 4D:
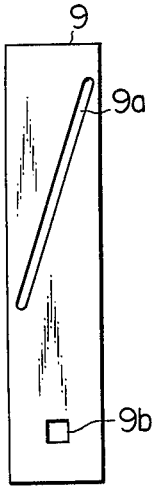
Figure 4B:
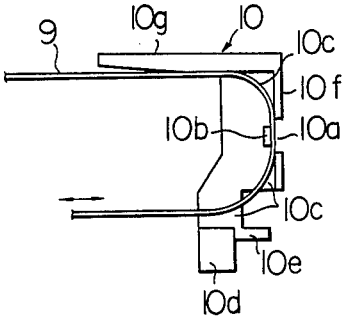
Figure 4C:
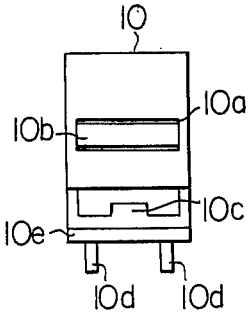

The ribbon 9 is guided by the portions 10*f* and 10*g* of the guide member 10 in directions perpendicular and parallel to the shaft 2 as shown in FIG. 4*b*. The guide member 10 is formed with a horizontal window 10*a* through which the ribbon 9 is visible.

The ribbon 9 is formed with a marking such as a slot 9*a* which obliquely extends along the length of the ribbon 9. As the ribbon 9 is moved as shown by an arrow in FIG. 4*b*, the part of the slot 9*a* visible through the window 10*a* moves from one side of the window 10*a* toward the other. This provides an indication of the position of the slider 5 and thereby the tuning voltage and frequency.

The guide member 10 is further provided with curved guide plates 10*c* and a guide bar 10*b* to guide the ribbon 9. It will be noticed that the direction of the ribbon 9 is reversed by 180° by the guide member 10 resulting in a compact configuration. Although not shown, graduations may be provided on the perpendicular portion 10*f* along the window 10*a* to provide a quantitative indication of the position of the slider 5.

The switch section C includes, as viewed in FIG. 3, a terminal support plate formed of an electrically insulating material and having a central aperture 11*a* through which the shaft 2 coaxially extends. Three recesses are provided in the terminal support plate 11 below the opening 11*a* so as to receive corresponding fixed terminals 12*a*, 12*b* and 12*c* therein, each of the recesses having the same configuration as that of the corresponding terminal and a depth equal to the thickness of the terminal. The terminals 12*a*, 12*b* and 12*c* are fixedly held in place in the corresponding recesses through engagement with corresponding projections which are all designated as 11*b* and are integral with the support plate 11.

The switch section C also includes a common terminal 13 which has a contact portion 13*a* formed with three rectangular apertures 13*b* and is fixedly received in a recess in the terminal support plate 11 through projections 11*b*, the recess having the same configuration as that of the common terminal 13. A central bend 13*d* of the common terminal 13 (see FIG. 8) extends to the rear of the terminal support plate 11 (see FIGS. 3 and 9) via a notch 11*f* defined between two projections 11*e* provided at one laterial edge of the terminal support plate 11, the bend 13*d* being contiguous with an external terminal portion 13*c*.

A switch housing 14 has an end wall 14*a* and side walls 14*c*. The end wall 14*a* is formed at the center thereof with an aperture 14*b* through which the shaft 2 coaxially extends while four inwardly projecting retainers 14*d* are provided at the upper and lower corners of the side walls 14*c*. The terminal support plate 11 is fixed to the housing 14 with shoulders 11*d* thereof retained by the corresponding retainers 14*d* mentioned above. Further designated by the reference numeral 14*e* is a bottom wall of the housing 14.

As viewed in FIG. 6, a movable member 15 is rotatably mounted in the housing 14 by a cylinder 15*c* thereof slidable in the aperture 14*b* of the housing 14. The movable member 15 is provided with another cylinder 15*b* which is rotatably slidable in the central aperture 11*a* of the terminal support plate 11. The cylinders 15*b* and 15*c* are commonly hollow so that the shaft 2 extends through a bore 15*f* thereof. A substantially rectangular member 15*a* is integrally provided to the movable member 15 so as to support an elongated movable contact wound thereround and consisting of a metal wire as will be described below. The aforementioned cylinders 15*b* and 15*c* project in opposite directions from the center of the member 15*a* in alignment with each other.

Reference numerals 15*d* and 15*e* designate a band indicator of the movable member 15 and projections retaining the contact 16 to the movable member 15, respectively.

The movable contact 16 thus fixed to the member 15 which in turn is rotatably mounted in the housing 14 is so shaped as to include an angular top or first contact 16*a* and a curved bottom or second contact 16*b* where opposite ends of the contact 16 overlap. With this arrangement, the first contact 16*a* moves along an arcuate path in contact with the contact portion 13*a* of the common terminal 13 when a control member or knob 17 (described below) is rotated whereas the second contact 16*b* engages with one of the contacts 12*a*, 12*b* or 12*c* to connect the common terminal 13 to the desired contact 12*a*, 12*b* or 12*c*.

The rectangular apertures 13*b* formed in the common terminal 13 releasably retain the first contact 16*a* to provide a detent function.

The control member section D will hereinafter be explained in detail with FIGS. 2 and 7. Reference numeral 17 designates the electrically insulated control knob associated with the switch section C and which has the outer periphery thereof knurled throughout its length. The knob 17 includes an extension 17*a* having an annular cross-section and a bottom wall 17*b* which is formed with an opening 17*c* for passing the shaft 2 therethrough and a pair of sectorial openings 17*d* for retainably receiving extensions 15*c*′ of the cylinder 15*c* of the movable member 15 which have a conjugate cross-section. The sectorial openings 17*d* diametrically oppose each other and are contiguous with the opening 17*c*. Cutouts 15*c*″ of the cylinder 15*c*, on the other hand, abut against corresponding peripheral portions 17*e* adjacent to the openings 17*d* and, therefore, serve as a stopper. The shaft 2 is freely rotatable while the movable member 15 is moved only when the knob 17 is rotated.

A knob 18 is provided to hold a knurled external end 2*b* of the shaft 2 in strong retaining engagement with inner periphery of a hollow cylinder 18*a*. The knob 18 when manipulated for rotation linearly moves the slider 5 and thereby the ribbon 9, and the knob 17 is rotated to control the switch section C in the manner described hereinabove.

The movable member 15 included in the switch section C has its indicator 15*d* rotatably disposed between the support plate 11 and the housing 14. The indicator 15*d* is movable in an arcuate path defined above and along curved tops of the plate 11 and the housing 14.

As has thus far been described, according to the present invention, the variable resistor section A and the indicator section B operable by the resistor section A are controlled by the knob 18 and the switch section C by the knob 17. The integral assembly of the sections A and C and the arrangement of the two different knobs 17 and 18 at a common location readily facilitate the band selection and tuning of the television receiver. Also, the television set can be made compact in size with a minimum space required for installation.

Various other advantages of the present tuning element assembly are embodied in the switch section C. The terminals 12*a*, 12*b*, 12*c* and 13 which would conventionally be secured by caulking or the like are, according to the invention, fixed in recesses of the terminal support plate 11 having configurations corresponding to the terminals with the aid of the projections 11*b*. The projections 11*b* engaging with the terminals 12*a*, 12*b* and 12*c* correspond in position to the roots of the soldering portions of the terminals, thus preventing flexation. The second contact 16*b* of the movable contact 16 remains in sliding contact with the flat surfaces of the terminals 12*a*, 12*b* and 12*c* while the first contact 16*a* slidingly moves on the flat contact portion 13*a* of the common terminal 13 which is formed with the rectangular apertures 13*b*. These apertures 13*b* provide a detent function as described above. Thus, various independent functions are integrated into the switch section C which has a simple construction and can be easily manipulated. Also, the knob 18 serves to detachably retain the sections A, B, C and D together thereby facilitating easy manufacturing, assembly and servicing.

It should be noted that while there has been herein shown and described a preferred embodiment of the present invention, such has been done for purposes of illustration only, and that various changes and modifications may be made within the scope of the appended claims. For example, the knob 17 provided to the switch section C may omitted if the indicator 15*d* is elongated to a substantial length to serve as a switching lever.

What is claimed is:

1. An electronic tuning element assembly comprising, in combination:

a variable tuning resistor having a straight resistance element with contacts at the ends thereof, a slider linearly movable along the resistance element and a threaded shaft screwably extending through the slider so that rotation of the shaft causes linear movement of the slider, a flexible ribbon connected at one end to the slider and a guide member, the ribbon slidably extending through the guide member; and a rotary tuning band switch detachably fixed to the guide member, the shaft extending through the switch coaxially therewith, the switch having a rotary control member, a movable contact fixed for rotation with the rotary control member and a plurality of fixed contacts with which the movable contact is engageable.

2. The electronic tuning assembly according to claim 1, in which the guide member has a perpendicular portion which is oriented perpendicular to the shaft.

3. The electronic tuning assembly according to claim 2, in which the guide member is formed with a parallel portion connected to the perpendicular portion and extending therefrom parallel to the shaft.

4. The electronic tuning assembly according to claim 2, in which the perpendicular portion of the guide member is formed with an elongated window through which the flexible ribbon is visible, the flexible ribbon being formed with an elongated marking obliquely along the length thereof so that a portion of the marking is visible through the window.

5. The electronic tuning assembly according to claim 1, further comprising a knob fixed to an end of the shaft which extends external of the rotary band switch.

6. The electronic tuning assembly according to claim 5, in which the knob detachably retains the rotary bank switch to the guide member.

7. The electronic tuning assembly according to claim 6, in which the variable tuning resistor comprises a casing which supports the resistance element, slider and shaft, the knob further detachably retaining the rotary band switch and the guide member to the casing.

8. The electronic tuning assembly according to claim 1, in which the rotary bank switch comprises detent means associated with the fixed contacts.

9. The electronic tuning assembly according to claim 1, in which the rotary control member is a knob.

10. The electronic tuning apparatus according to claim 1, further comprising a band indicator fixed to the movable contact for rotation with the movable contact.

* * * * *